US011167163B2

(12) United States Patent
Chin

(10) Patent No.: US 11,167,163 B2
(45) Date of Patent: Nov. 9, 2021

(54) LEG REHABILITATION EXERCISE APPARATUS

(71) Applicant: Hua Chin, Taipei (TW)

(72) Inventor: Hua Chin, Taipei (TW)

( * ) Notice: Subject to any disclaimer, the term of this patent is extended or adjusted under 35 U.S.C. 154(b) by 134 days.

(21) Appl. No.: 16/655,819

(22) Filed: Oct. 17, 2019

(65) Prior Publication Data

US 2021/0113877 A1 Apr. 22, 2021

(51) Int. Cl.
*A63B 21/00* (2006.01)
*A63B 22/06* (2006.01)
(Continued)

(52) U.S. Cl.
CPC ..... *A63B 21/00185* (2013.01); *A61H 1/0244* (2013.01); *A63B 21/055* (2013.01);
(Continued)

(58) Field of Classification Search
CPC ..... A61H 1/00; A61H 1/0237; A61H 1/0244; A61H 2201/0161; A61H 2201/1276; A61H 2201/1623; A61H 2201/1633; A61H 2201/1635; A61H 2201/164; A61H 2203/0437; A61H 2205/10; A63B 21/00069; A63B 21/00076; A63B 21/00178; A63B 21/00185; A63B 21/012; A63B 21/0125; A63B 21/015; A63B 21/018; A63B 21/068; A63B 21/15; A63B 21/151; A63B 21/154; A63B 21/159; A63B 21/22; A63B 21/225; A63B 21/4027; A63B 21/4033; A63B 21/4034; A63B 21/4035; A63B 21/4045; A63B 21/4047; A63B 21/4049; A63B 22/0002; A63B 22/0005;
(Continued)

(56) References Cited

U.S. PATENT DOCUMENTS 326,247 A * 9/1885 Root ..... A63B 22/0056 482/56
3,731,921 A * 5/1973 Andrews, Jr. ..... A63B 69/10 482/56
(Continued)

FOREIGN PATENT DOCUMENTS

GB 2027598 A * 2/1980 ..... A63B 22/205

*Primary Examiner* — Gary D Urbiel Goldner

(57) ABSTRACT

The present invention provides a leg rehabilitation exercise apparatus, which includes: a base; a seat arranged on the base; a leg exercise frame arranged on the base; an upper rotation-supporting member arranged on the leg exercise frame; a lower rotation-supporting member arranged on the leg exercise frame; a reciprocating motion section including a left lifting/lowering motion section, a right lifting/lowering motion section, an upper connection section, and a lower connection section; a left lifting/lowering member arranged on the left lifting/lowering motion section; and a right lifting/lowering member arranged on the right lifting/lowering motion section. The left lifting/lowering motion section and the right lifting/lowering motion section are operable to do lifting/lowering motions in opposite directions. The leg rehabilitation exercise apparatus of the present invention achieves an effective result of training quadriceps muscles of thighs and shanks and is also an operation safe device.

9 Claims, 9 Drawing Sheets

(51) Int. Cl.

| | |
|---|---|
| ***A63B 21/055*** | (2006.01) |
| ***A63B 22/00*** | (2006.01) |
| ***A63B 21/22*** | (2006.01) |
| ***A61H 1/02*** | (2006.01) |

(52) U.S. Cl.
CPC ..... *A63B 21/154* (2013.01); *A63B 21/225* (2013.01); *A63B 21/4034* (2015.10); *A63B 21/4035* (2015.10); *A63B 22/0005* (2015.10); *A63B 22/0046* (2013.01); *A63B 22/06* (2013.01); *A61H 2201/1276* (2013.01); *A63B 2022/0094* (2013.01); *A63B 2225/09* (2013.01)

(58) Field of Classification Search
CPC ..... A63B 22/0046; A63B 22/06; A63B 22/18; A63B 2022/0094; A63B 23/035; A63B 23/03516; A63B 23/03525; A63B 23/03533; A63B 23/04; A63B 23/0405; A63B 23/0482; A63B 2208/0228; A63B 2208/0233; A63B 2225/09
See application file for complete search history.

(56) References Cited

U.S. PATENT DOCUMENTS

| | | | | | |
|---|---|---|---|---|---|
| 4,540,172 | A * | 9/1985 | Evans | A63B 21/018 | 482/120 |
| 5,040,785 | A * | 8/1991 | Charnitski | A63B 23/0417 | 482/51 |
| 5,295,927 | A * | 3/1994 | Easley | A63B 21/015 | 482/51 |
| 5,299,995 | A * | 4/1994 | Ko | A63B 23/0417 | 482/52 |
| 5,366,426 | A * | 11/1994 | Glavin | A63B 23/03516 | 482/126 |
| 5,492,515 | A * | 2/1996 | Charnitski | A63B 22/001 | 482/37 |
| 5,961,423 | A * | 10/1999 | Sellers | A63B 22/001 | 482/52 |
| 6,331,153 | B1 * | 12/2001 | McClellan | A63B 22/205 | 482/52 |
| 6,702,722 | B1 * | 3/2004 | Arroyo, Jr. | A63B 21/012 | 482/37 |
| 7,740,563 | B2 * | 6/2010 | Dalebout | A63B 22/0012 | 482/52 |
| D853,504 | S * | 7/2019 | Mercenari Uribe | A63B 22/001 | D21/670 |
| 2003/0087730 | A1 * | 5/2003 | Wu | A63B 22/0664 | 482/51 |
| 2015/0051520 | A1 * | 2/2015 | Donohue | A61H 1/0266 | 601/35 |
| 2019/0054342 | A1 * | 2/2019 | Christy | A61H 1/0244 | |
| 2019/0160331 | A1 * | 5/2019 | Mercenari Uribe | A63B 21/008 | |
| 2020/0171346 | A1 * | 6/2020 | Chen | A63B 22/205 | |

* cited by examiner

LEG REHABILITATION EXERCISE APPARATUS

FIELD OF THE INVENTION

The present invention relates to a leg rehabilitation exercise apparatus, and more particular to a leg rehabilitation apparatus that lifts and lowers shanks in such a way that achieves muscle endurance training through resistive motions to improve quadriceps muscles and strengthen muscles of a lower part of a human body and preventing loss of muscle power.

BACKGROUND OF THE INVENTION

Degenerative arthritis is a kind of bone disease caused by wear of articular cartilage of knees that result in direct contact between adjacent bones at the knee joints. A degenerative arthritis patient would suffer various symptoms, such as pains, knee stiffness, strange sound, and even deformation and swelling. Degenerative arthritis occurs with aging and may also be caused by excessive body weight, violent exercise, and heavy labor work. Thus, the elder, the overweight, athletes, and people experiencing knee joint damages are the population groups that are most likely to suffer degenerative arthritis.

Degenerative arthritis is commonly treated with medication therapy or administration of glucosamine sulfate to alleviate discomfort and to relieve pain, and patients are also asked to take periodic knee joint motion and to stretch and train muscles around the knee joints, but avoiding excessively violent exercises. However, leg-related fitness devices that are currently available in the market mostly place emphasis on training of muscle power of thighs by having an exerciser, who is set in a sitting posture, forcibly treading down pedals to lift weights. Such a movement imposes great loading to the knee joints and consequently, such fitness devices are not fit to patients of degenerative arthritis or people whose knee joints cannot support violent exercises.

The present invention aims to provide a leg rehabilitation exercise apparatus that overcomes the above-discussed drawbacks of the prior art.

SUMMARY OF THE INVENTION

The primary objective of the present invention is to provide a leg rehabilitation exercise apparatus, which enables training of muscle power of thighs and shanks. Due to the improved muscle power, muscle loss can be prevented and stress may be spread to thereby provide a sound and firm support to the joints. Further, a pulling force assembly is arranged at two lateral sides and upper and lower parts of abase to enable training of arm muscles and training of chest expansion to achieve an effect of exercise of the entire body.

Thus, to achieve the above objective, the present invention provides a leg rehabilitation exercise apparatus, which comprises: abase; a seat, which is arranged on the base; a leg exercise frame, which is arranged on the base; an upper rotation-supporting member, which is arranged on the leg exercise frame in a manner of being rotatable about a first rotating axle; a lower rotation-supporting member, which is arranged on the leg exercise frame in a manner of being rotatable about a second rotating axle, the second rotating axle being arranged below the first rotating axle in a vertical direction; a reciprocating motion section, which includes a left lifting/lowering motion section, a right lifting/lowering motion section, an upper connection section, and a lower connection section, wherein the upper connection section has two ends that are respectively connected to an upper end of the left lifting/lowering motion section and an upper end of the right lifting/lowering motion section, the upper connection section and the upper rotation-supporting member being set in moving coupling with each other as being in direct contact with each other; and the lower connection section has two ends that are respectively connected to a lower end of the left lifting/lowering motion section and a lower end of the right lifting/lowering motion section, the lower connection section and the lower rotation-supporting member being set in moving coupling with each other as being indirect contact with each other; a left lifting/lowering member, which is arranged on the left lifting/lowering motion section, the left lifting/lowering member comprising a left leg supporting section; and a right lifting/lowering member, which is arranged on the right lifting/lowering motion section, the right lifting/lowering member comprising a right leg supporting section, wherein the left lifting/lowering motion section and the right lifting/lowering motion section are operable to do lifting/lowering motions that are movements made in opposite directions.

In an embodiment of the present invention, a leg rehabilitation exercise apparatus is provided, wherein the base comprises a resistive force mechanism, and the resistive force mechanism comprises a treading pedal.

In an embodiment of the present invention, a leg rehabilitation exercise apparatus is provided, wherein the resistive force mechanism comprises one or both of a flywheel device and a thigh pushing/treading device.

In an embodiment of the present invention, a leg rehabilitation exercise apparatus is provided, wherein the treading pedal of the thigh pushing/treading device comprises two supporting sections raised or projecting therefrom and a jointing section, the supporting sections being respectively arranged at a left side and a right side, the jointing section being arranged to connect the two supporting sections.

In an embodiment of the present invention, a leg rehabilitation exercise apparatus is provided, further comprising a pulling force assembly, wherein the pulling force assembly comprises an elastic element and a grip, the elastic element having an end connected to the seat or the base, the elastic element having an opposite end connected to the grip.

In an embodiment of the present invention, a leg rehabilitation exercise apparatus is provided, wherein the grip is provided with a secondary rotary grip, the secondary rotary grip being arranged in a manner of being rotatable toward an inner side of the seat.

In an embodiment of the present invention, a leg rehabilitation exercise apparatus is provided, wherein the upper rotation-supporting member comprises one of a pulley, a toothed wheel, and a belt roller and the lower rotation-supporting member comprises one of a pulley, a toothed wheel, and a belt roller; and the reciprocating motion section comprises one of a rope, a chain, and a belt.

In an embodiment of the present invention, a leg rehabilitation exercise apparatus is provided, wherein the leg exercise frame comprises a counter device, which detects and count times that the left lifting/lowering member and the right lifting/lowering member move and pass over the counter device.

In an embodiment of the present invention, a leg rehabilitation exercise apparatus is provided, wherein the leg exercise frame is arranged on the base in a removable manner.

In an embodiment of the present invention, a leg rehabilitation exercise apparatus is provided, wherein the leg exercise frame is arranged on the base in a rotatable manner and the leg exercise frame comprises a rotary knob to adjust an angle of inclination of the leg exercise frame.

In light of the techniques provided in the present invention, a leg rehabilitation exercise apparatus is disclosed, in which by means of an arrangement of the leg exercise frame, the upper rotation-supporting member, the lower rotation-supporting member, the reciprocating motion section, the left lifting/lowering member, and the right lifting/lowering member, a user is allowed to place the left and right shanks on the apparatus to carry out lifting/lowering motions so as to achieve effects of providing proper movement to the knee joints and training muscles around the knees in a condition of not imposing undue loading to the knees. The leg rehabilitation exercise apparatus may be additionally combined with a resistive force mechanism and a pulling force assembly to achieve an effect of training the cardiorespiratory function, and at the same time training the hand muscles. The leg rehabilitation exercise apparatus of the present invention has a simple structure, is easy to detach and store, and also helps save fabrication costs.

In summary, the present invention provides innovation in respect of spatial arrangement and further provides various additional functions as compared to the prior art, and as such, the present invention is novel and inventive.

DETAILED DESCRIPTION OF THE PREFERRED EMBODIMENTS

Figure 1A:
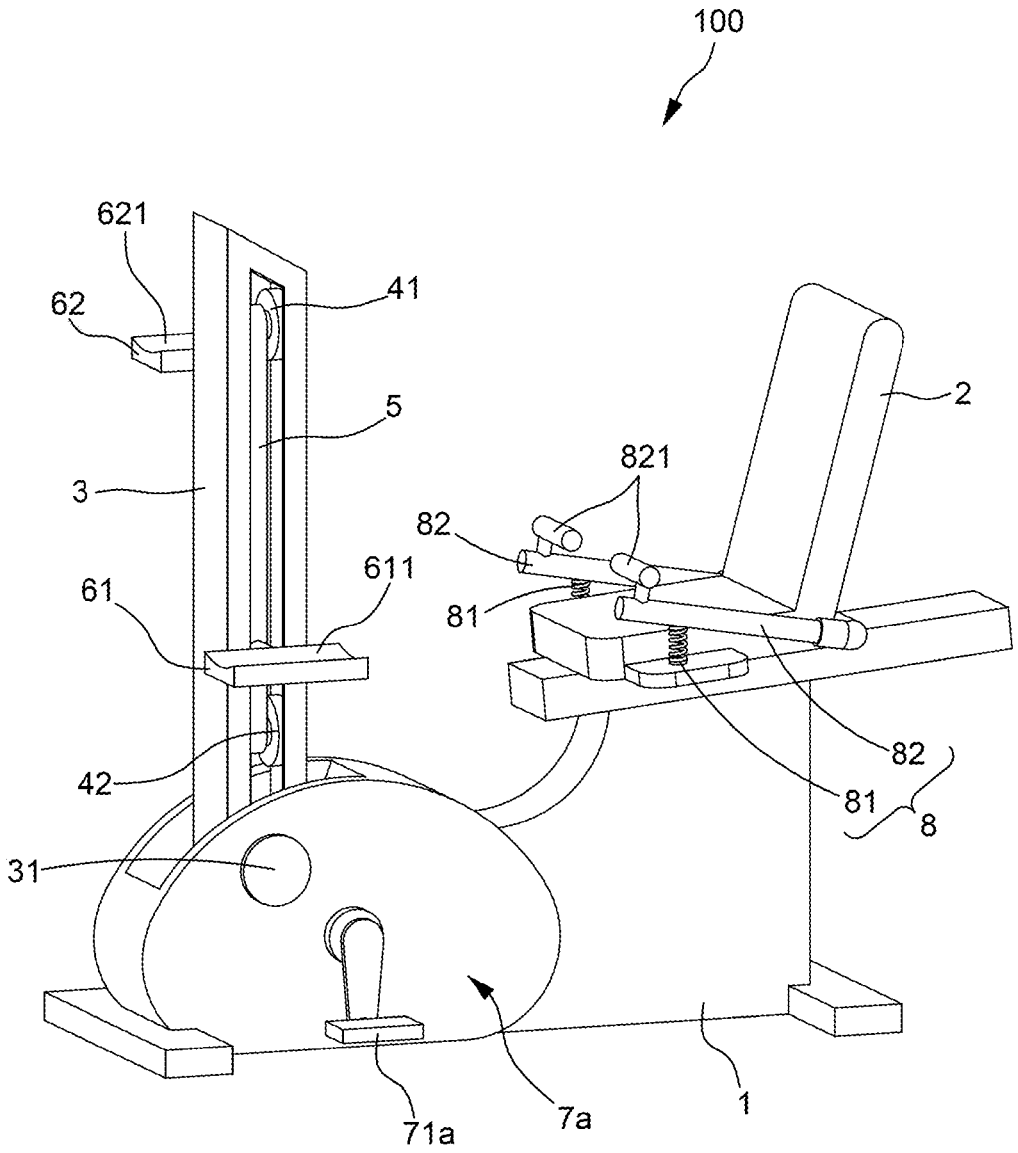
FIG. 1*a* is a perspective view illustrating an embodiment of a leg rehabilitation exercise apparatus according to the present invention.

Embodiments of the present invention will be described below with reference to FIGS. 1*a*-4. The description is not provided for constraining the ways of embodying the present invention, and is provided as an example or examples for explaining one or some ways of the embodiment of the present invention.

Firstly, referring to FIGS. 1*a*-2*b* collectively, a leg rehabilitation exercise apparatus 100 is shown, comprising a base 1, a seat 2, a leg exercise frame 3, an upper rotation-supporting member 41, a lower rotation-supporting member 42, a reciprocating motion section 5, a left lifting/lowering member 61, and a right lifting/lowering member 62.

To indicate relative positions among various elements and to facilitate understanding of the present invention, in the following description, direction-related terminology, such as "left", "right", "upper", "lower", "front" and "rear", are defined as directions of observation that an exerciser made from a seat 2 toward a leg exercise frame 3.

The base 1 is positionable on a ground surface or a fixture surface to support other components of the leg rehabilitation exercise apparatus 100.

The seat 2 is arranged on the base 1 and includes a seat cushion and a seat back for sitting of an exerciser thereon. Preferably, the seat 2 is arranged to be position-adjustable in a front-rear direction of the base 1 or height adjustable in order to match the height or leg length of the exerciser. The seat 2 is not limited to the fashion of the chair shown in the drawings and can alternatively be arranged in a form that allows the exerciser to lie horizontally thereon.

The leg exercise frame 3 is arranged on the base 1. Preferably, the leg exercise frame 3 is mounted in a detachable or removable manner in order to facilitate transportation and storage of the leg rehabilitation exercise apparatus 100.

The upper rotation-supporting member 41 is arranged on or mounted to the leg exercise frame 3 in a manner of being rotatable about a first rotating axle P1.

The lower rotation-supporting member 42 is arranged on the leg exercise frame 3 or mounted to the leg exercise frame 3 in a manner of being rotatable about a second rotating axle P2. The second rotating axle P2 is arranged vertically under or lower than the first rotating axle P1.

Figure 2A:
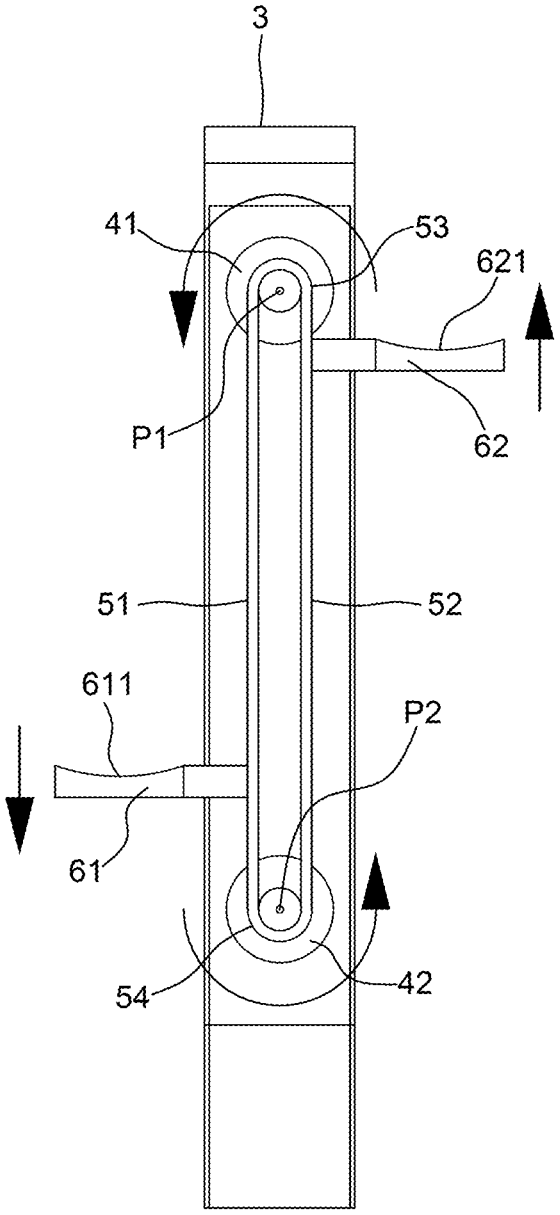
FIG. 2*a* is a schematic view illustrating a condition of operation of a reciprocating motion section of the leg rehabilitation exercise apparatus according to the present invention.
Figure 2B:
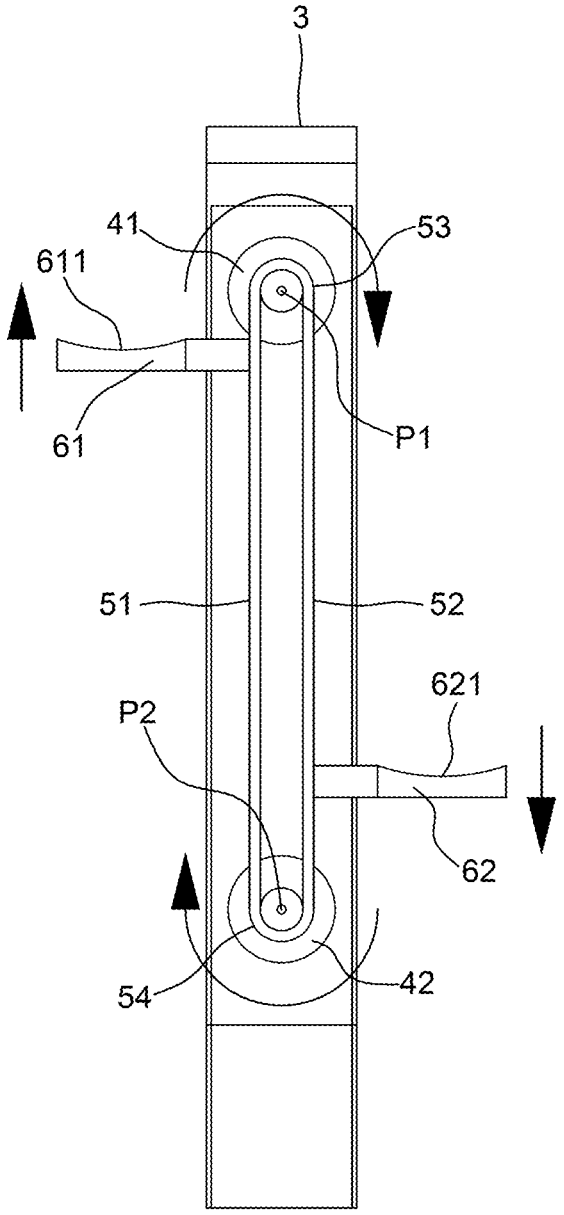
FIG. 2*b* is another schematic view illustrating a condition of operation of the reciprocating motion section of the leg rehabilitation exercise apparatus according to the present invention.

Further reference is made to FIGS. 2*a* and 2*b*. The reciprocating motion section 5 includes a left lifting/lowering motion section 51, aright lifting/lowering motion section 52, an upper connection section 53, and a lower connection section 54.

The upper connection section 53 has two ends that are respectively connected to an upper end of the left lifting/lowering motion section 51 and an upper end of the right lifting/lowering motion section 52. The upper connection section 53 is arranged in direct contact or engagement with the upper rotation-supporting member 41 to form movement coupling therebetween by means of, for example, a frictional force present between the two or projection-and-recess coupling engagement between the two.

The lower connection section 54 has two ends that are respectively connected to a lower end of the left lifting/lowering motion section 51 and a lower end of the right lifting/lowering motion section 52. The lower connection section 54 is arranged in direct contact or engagement with the lower rotation-supporting member 42 to form movement coupling therebetween by means of, for example, a frictional force present between the two or projection-and-recess coupling engagement between the two.

In some embodiments, the upper rotation-supporting member 41 and the lower rotation-supporting member 42 can be pulleys, toothed wheels, or belt rollers. The reciprocating motion section 5 can be a rope, a chain, or a belt.

In case that the reciprocating motion section 5 is a rope or a belt, the upper rotation-supporting member 41 and the lower rotation-supporting member 42 are pulleys or belt rollers matching the rope or the belt to induce a frictional force therebetween to drive the upper rotation-supporting member 41 and the lower rotation-supporting member 42 to rotate in a clockwise direction or a counterclockwise direction and the rope or belt itself moves while curving around the upper rotation-supporting member 41 and the lower rotation-supporting member 42. In case that the reciprocating motion section 5 is a chain, the upper rotation-supporting member 41 and the lower rotation-supporting member 42 are toothed wheels or chain wheels that match the chain such that a projection-and-recess engagement is provided between the chain and the toothed wheels, allowing the chain to drive the upper rotation-supporting member 41 and the lower rotation-supporting member 42 to rotate in a clockwise direction or a counterclockwise direction and the chain itself moves while curving around the upper rotation-supporting member 41 and the lower rotation-supporting member 42. In such example embodiments, the rope, chain, or belt is arranged to curve around only a portion of a circumference of each of the upper rotation-supporting member 41 and the lower rotation-supporting member 42, and different sections or segments of the rope, chain or belt serve as the left lifting/lowering motion section 51, the right lifting/lowering motion section 52, the upper connection section 53, and the lower connection section 54, respectively. The left lifting/lowering motion section 51 and the right lifting/lowering motion section 52 are arranged to move with lifting/lowering motions that are in opposite directions.

The left lifting/lowering member 61 is arranged on the left lifting/lowering motion section 51. The left lifting/lowering member 61 includes a left leg supporting section 611 for receiving the left shank of the exerciser to place thereon.

The right lifting/lowering member 62 is arranged on the right lifting/lowering motion section 52. The right lifting/lowering member 62 includes a right leg supporting section 621 for receiving the right shank of the exerciser to place thereon. Preferably, the left lifting/lowering member 61 and the right lifting/lowering member 62 are arranged or mounted in a detachable or removable manner to suit the need for ease and convenience of transportation and storage. Preferably, the leg exercise frame 3 is arranged on the base 1 in a rotatable manner, and the leg exercise frame 3 is provided with a rotary knob 31 for adjusting an angle of inclination of the leg exercise frame 3.

Preferably, the lifting/lowering motions of the left lifting/lowering motion section 51 and the right lifting/lowering motion section 52 are carried out as motions in a vertical direction so that the left lifting/lowering member 61 and the right lifting/lowering member 62 are moveable for ascending and descending in a direction generally perpendicular to the ground surface that is generally horizontal, and thus, the legs of the exerciser only undergo variation of vertical positions thereof as being ascended (lifted) or descend (lowered) in the process of exercise without any change of an angle between the two legs in a left-right direction. An example embodiment is that the upper rotation-supporting member 41 and the lower rotation-supporting member 42 are pulleys (or toothed wheels or belt rollers) that are identical in specification and the reciprocating motion section 5 is a rope (or a chain or a belt) corresponding thereto.

Figure 3:
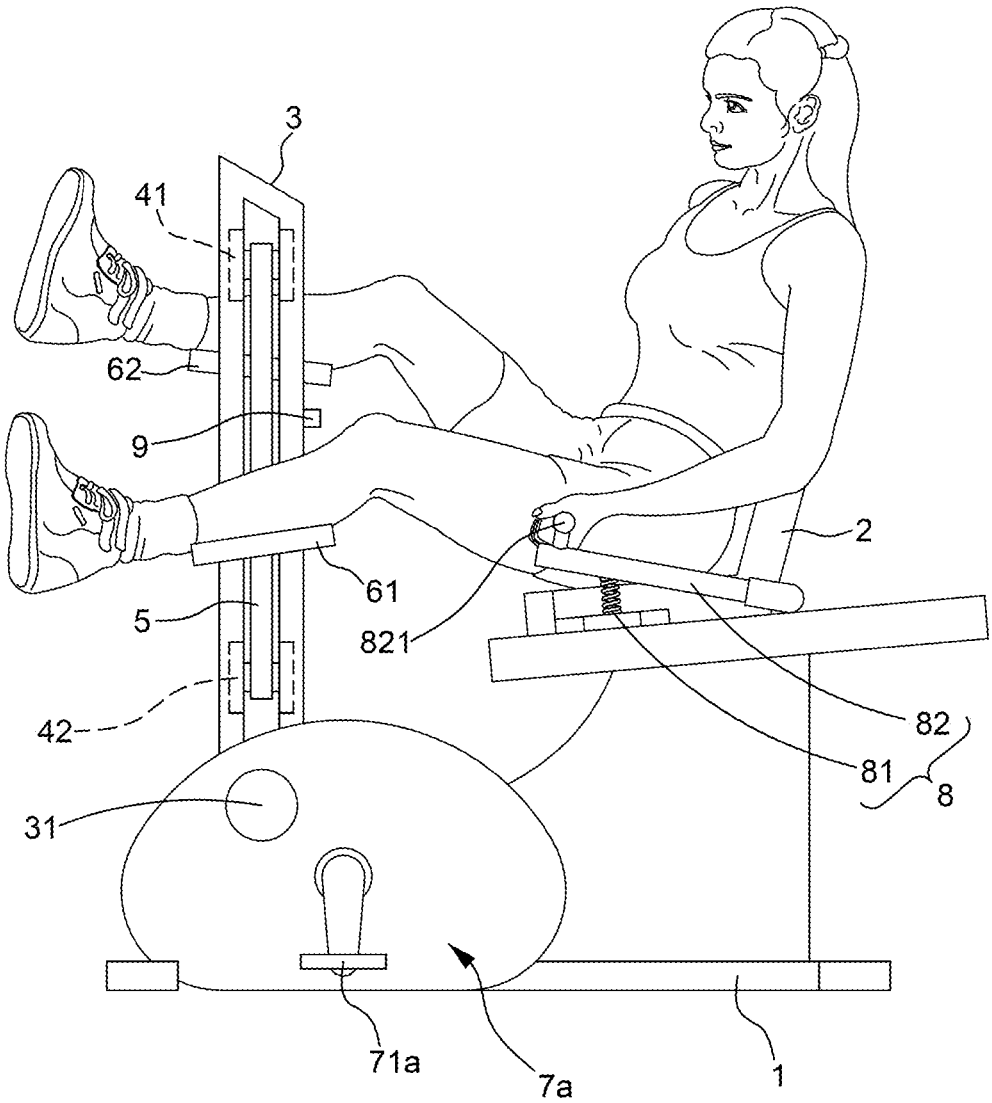
FIG. 3 is a schematic view illustrating using the use of the leg rehabilitation exercise apparatus according to the present invention.

As shown in FIG. 3, the exerciser applies different forces to the left leg supporting section 611 and the right leg supporting section 621 by means of the left and right shanks so as to cause the left lifting/lowering member 61 and the right lifting/lowering member 62 to drive the left lifting/lowering motion section 51, the right lifting/lowering motion section 52, the upper connection section 53, the lower connection section 54, the upper rotation-supporting member 41, and the lower rotation-supporting member 42 into motion, such that the left lifting/lowering member 61 and the right lifting/lowering member 62 lift or lower (as shown in FIGS. 2*a* and 2*b*) to achieve the purpose of leg exercise.

In the instant embodiment, the base 1 is further provided with a resistive force mechanism. The resistive force mechanism is connected to a treading pedal to enable a user to carry out training and exercise of legs for fitness. The resistive force mechanism can be a flywheel device 7*a*, and the exerciser may achieve an effect of body fitness similar to bike riding through pedaling the treading pedal 71*a*.

Figure 5:
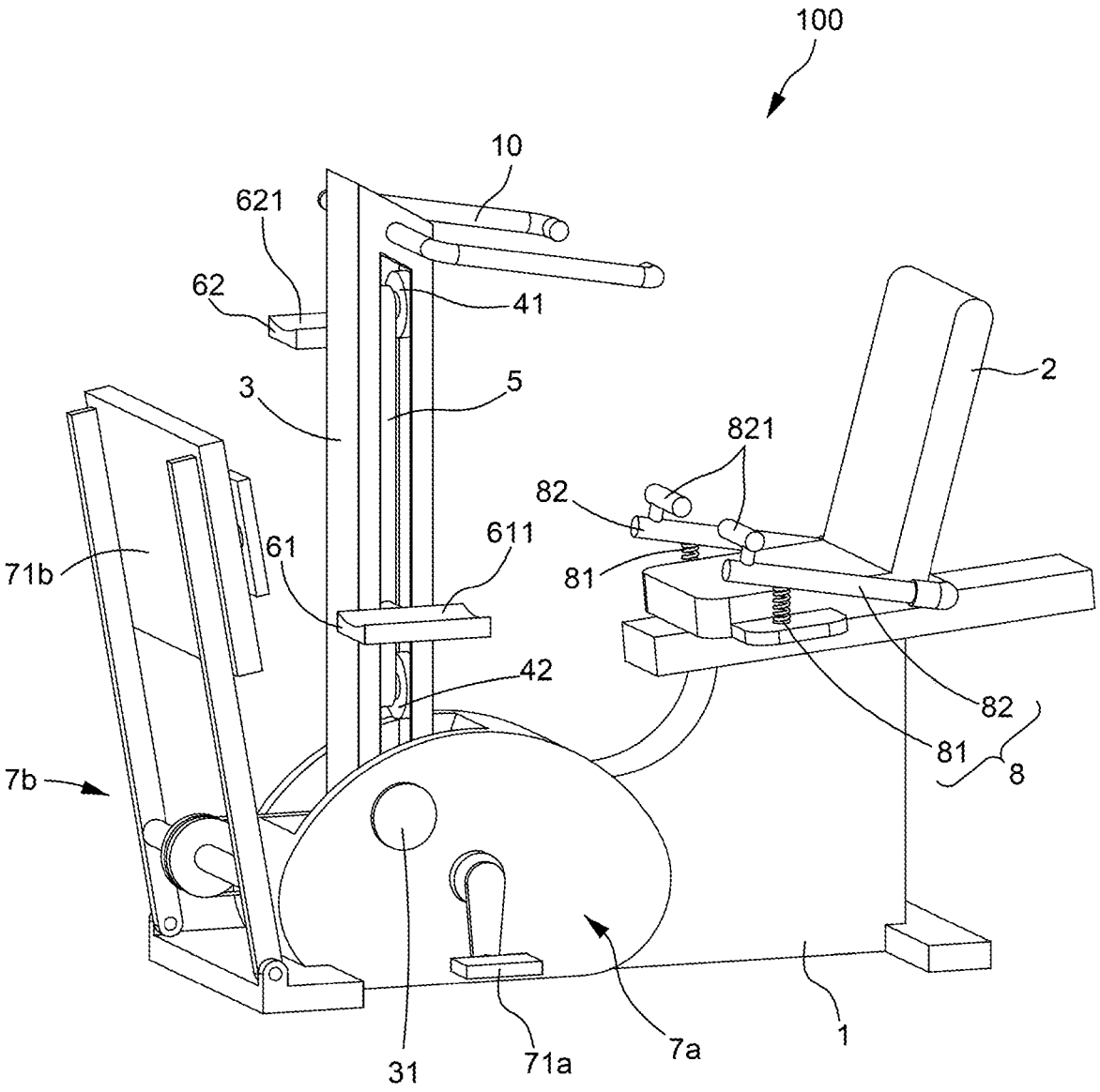
FIG. 5 is a perspective view illustrating said embodiment of the leg rehabilitation exercise apparatus according to the present invention.
Figure 6:
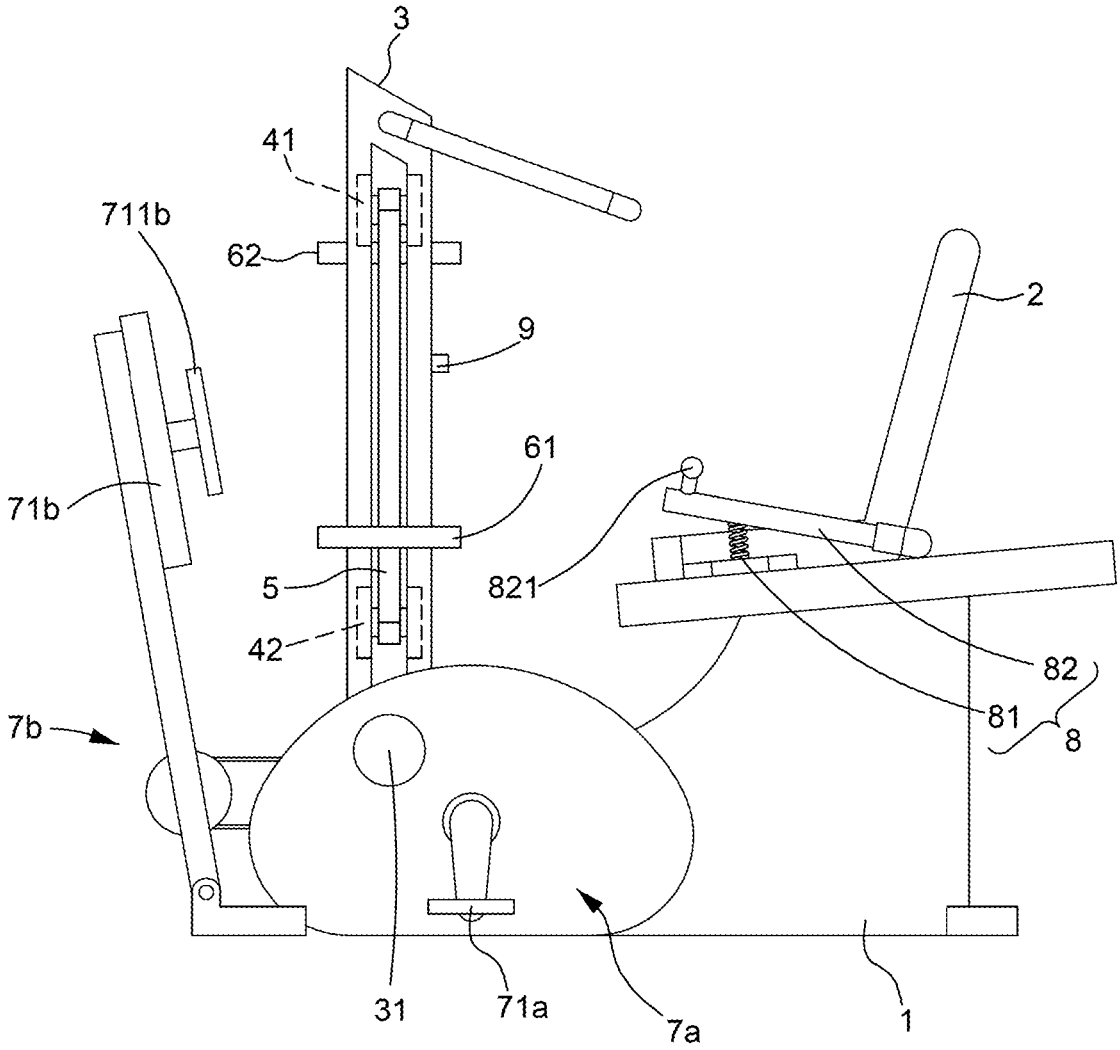
FIG. 6 is a front view of FIG. 5.
Figure 7:
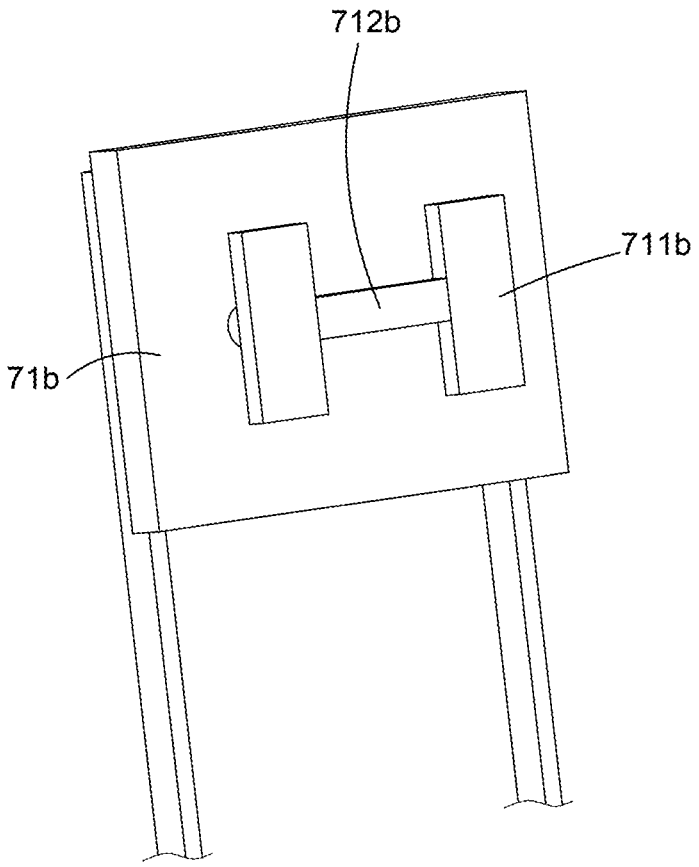
FIG. 7 is a schematic view illustrating an embodiment of a supporting section of a thigh pushing/treading device of the leg rehabilitation exercise apparatus according to the present invention.

Referring to FIGS. 5 and 6, in another embodiment, the resistive force mechanism comprises a thigh pushing/treading device 7*b*. An exerciser may use two feet to push or tread the treading pedal 71*b* for the training of thigh muscles. Optionally, as shown in FIG. 7, in an embodiment, the treading pedal 71*b* includes two supporting sections 711*b* raised or projecting therefrom and a jointing section 712*b*. The two supporting sections 711*b* are arranged, in pair, to be respectively located at a left side and a right side, and the jointing section 712*b* is connected to and between the two supporting sections 711*b*. In the leg rehabilitation exercise apparatus 100 according to the present invention, the flywheel device 7*a* and the thigh pushing/treading device 7*b* can be both include or alternatively just one of the two is included.

In the instant embodiment, the leg rehabilitation exercise apparatus 100 may further comprise a pulling force assembly 8. The pulling force assembly 8 comprises an elastic element 81 and a grip 82. The elastic element 81 has an end connected to the seat 2 or the base 1, and an opposite end of the elastic element 81 is connected to the grip 82. The elastic element 81 can be for example of a spring. As shown in FIG. 3, the exerciser may achieve an effect of training hand muscles by lifting the grip 82 in a way similar to lifting a pair of dumbbells.

Figure 4:
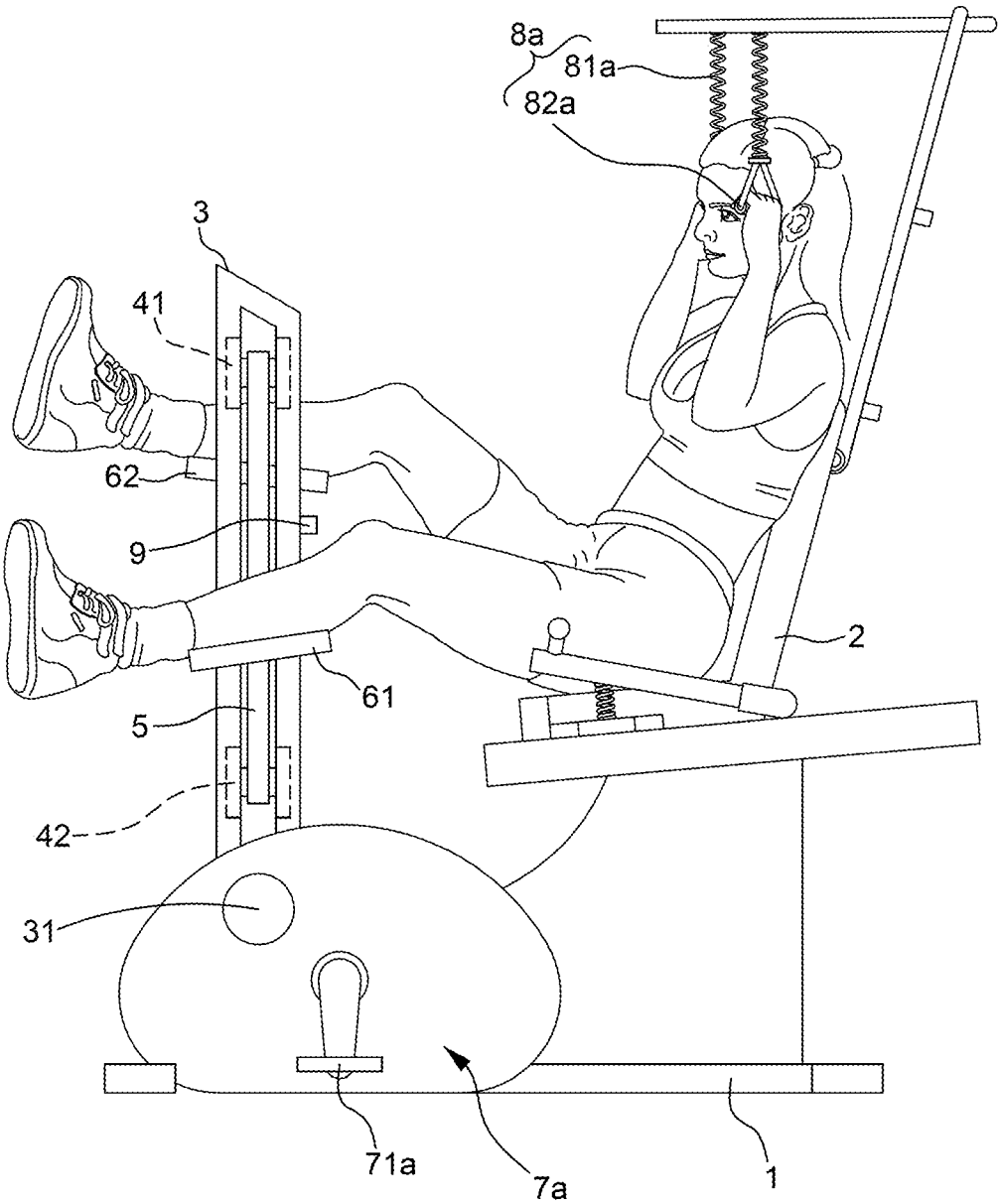
FIG. 4 is a schematic view illustrating the use of another embodiment of the leg rehabilitation exercise apparatus according to the present invention.

In another embodiment, as shown in FIG. 4, a pulling force assembly 8*a* may be arranged on the seat 2 at a relatively high location, such that the exerciser may achieve an effect of training hand muscles by pulling down the grip 82*a* to stretch the elastic element 81*a*.

Figure 1B:
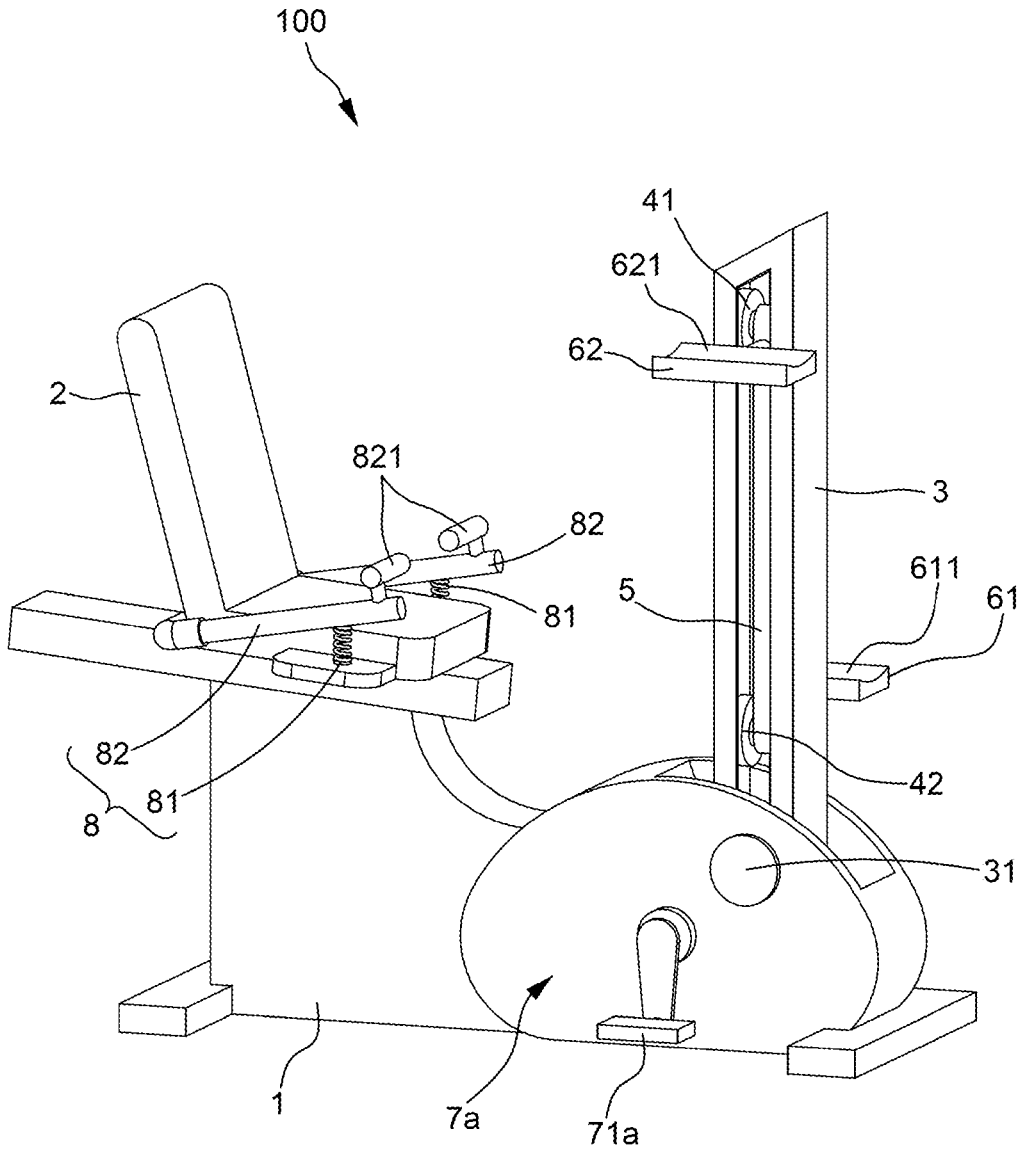
FIG. 1*b* is another perspective view of the embodiment of the leg rehabilitation exercise apparatus according to the present invention taken from the opposite side.

Optionally, as shown in FIGS. 1*a* and 1*b*, the grip 82 may be connected to a secondary or auxiliary rotary grip 821. The secondary rotary grip 821 is arranged to be rotated in a direction toward an inner side of the seat 2. In case that the pulling force assembly 8 is not used or after use is finished, the secondary rotary grip 821 can be rotated to align in the front-rear direction to allow the exerciser to sit on or leave the seat 2 easily. To use the pulling force assembly 8, the secondary rotary grip 821 is rotated in a direction toward the inner side to allow the exerciser to easily apply a force to the pulling force assembly 8.

Preferably, in an embodiment, the leg exercise frame 3 is provided with a counter device 9 to detect and count the number that the left lifting/lowering member 61 and the right lifting/lowering member 62 move and pass over the counter device 9. The exerciser may get immediately aware of the times of exercise of the legs by means of the counter device 9.

Optionally, as shown in FIG. 5, the leg exercise frame 3 is provided with a handle 10 to serve as a handrail which the exerciser may grip during the process of exercise.

As a brief of the present invention presented with the above embodiments, it is appreciated that the leg rehabilitation exercise apparatus according to the present invention has a structure that is simple, allowing an exerciser to take a sitting posture or a flat-lying posture, and achieving a purpose of training muscles around the knee joints (such as quadriceps muscles) and also properly moving the knee joints through moving the thighs by lifting and lowering the shanks in a condition of not causing undue loading to the knee joints. The leg rehabilitation exercise apparatus of the present invention is suitable for people suffering degenerative joint disease or exercisers who knee joints are not capable of bearing violent movement; but is still equally suitable for people having perfect health condition to use. The leg rehabilitation exercise apparatus may be additionally provided with a resistive force mechanism and a pulling force structure to provide a pulling force structure that provides effects of training cardiorespiratory function, thigh muscles, and hand muscles of an exerciser.

What is claimed is:

1. A leg rehabilitation exercise apparatus, comprising:

a base;

a seat, which is arranged on the base;

a leg exercise frame, which is arranged on the base;

an upper rotation-supporting member, which is arranged on the leg exercise frame in a manner of being rotatable about a first rotating axle;

a lower rotation-supporting member, which is arranged on the leg exercise frame in a manner of being rotatable about a second rotating axle, the second rotating axle being arranged below the first rotating axle in a vertical direction;

a reciprocating motion section, which includes a left lifting/lowering motion section, a right lifting/lowering motion section, an upper connection section, and a lower connection section, wherein the upper connection section has two ends that are respectively connected to an upper end of the left lifting/lowering motion section and an upper end of the right lifting/lowering motion section, the upper connection section and the upper rotation-supporting member being set in moving coupling with each other as being in direct contact with each other; and the lower connection section has two ends that are respectively connected to a lower end of the left lifting/lowering motion section and a lower end of the right lifting/lowering motion section, the lower connection section and the lower rotation-supporting member being set in moving coupling with each other as being in direct contact with each other;

a left lifting/lowering member, which is arranged on the left lifting/lowering motion section, the left lifting/lowering member comprising a left leg supporting section; and a right lifting/lowering member; which is arranged on the right lifting/lowering motion section, the right lifting/lowering member comprising a right leg supporting section;

wherein the left lifting/lowering motion section and the right lifting/lowering motion section are operable to do lifting/lowering motions that are movements made in opposite directions; and a pulling force assembly comprising an elastic element and a grip, the elastic element having an end connected to the seat or the base, the elastic element having an opposite end connected to the grip.

2. The leg rehabilitation exercise apparatus according to claim 1, wherein the base comprises a resistive force mechanism, and the resistive force mechanism comprises a thigh pushing/treading device having a treading pedal.

3. The leg rehabilitation exercise apparatus according to claim 2, wherein the resistive force mechanism further comprises a flywheel device.

4. The leg rehabilitation exercise apparatus according to claim 3, wherein the treading pedal of the thigh pushing/treading device comprises two supporting sections raised or projecting therefrom and a jointing section, the two supporting sections being respectively arranged at a left portion and a right portion of the treading pedal, the jointing section being arranged to connect the two supporting sections.

5. The leg rehabilitation exercise apparatus according to claim 1, wherein the grip is provided with a secondary rotary grip, the secondary rotary grip being arranged in a manner of being rotatable toward an inner side of the seat.

6. The leg rehabilitation exercise apparatus according to claim 1, wherein the upper rotation-supporting member comprises one of a first pulley, a first toothed wheel, and a first belt roller and the lower rotation-supporting member comprises one of a second pulley, a second toothed wheel, and a second belt roller; and the reciprocating motion section comprises one of a rope, a chain, and a belt.

7. The leg rehabilitation exercise apparatus according to claim 1, wherein the leg exercise frame comprises a counter device, which detects and count times that the left lifting/lowering member and the right lifting/lowering member move and pass over the counter device.

8. The leg rehabilitation exercise apparatus according to claim 1, wherein the leg exercise frame is arranged on the base in a removable manner.

9. The leg rehabilitation exercise apparatus according to claim 1, wherein the leg exercise frame is arranged on the base in a rotatable manner and the leg exercise frame comprises a rotary knob to adjust an angle of inclination of the leg exercise frame.

* * * * *